US009907364B1

(12) United States Patent
Bosserman

(10) Patent No.: US 9,907,364 B1
(45) Date of Patent: Mar. 6, 2018

(54) SHOE FASTENING APPARATUSES, SYSTEMS AND METHODS OF USING THE SAME

(71) Applicant: Richard Bosserman, Crystal Lake, IL (US)

(72) Inventor: Richard Bosserman, Crystal Lake, IL (US)

( * ) Notice: Subject to any disclaimer, the term of this patent is extended or adjusted under 35 U.S.C. 154(b) by 0 days.

(21) Appl. No.: 15/432,725

(22) Filed: Feb. 14, 2017

(51) Int. Cl.
*A43C 11/14* (2006.01)
*A47G 25/80* (2006.01)

(52) U.S. Cl.
CPC ..... *A43C 11/1493* (2013.01); *A47G 25/80* (2013.01)

(58) Field of Classification Search
CPC ..... A43C 11/1493; A43C 11/24; A47G 25/80; A41D 2300/32
USPC ..... 12/142 LC
See application file for complete search history.

(56) References Cited

U.S. PATENT DOCUMENTS 4,079,527 A 3/1978 Antonius
4,878,274 A * 11/1989 Patricy ..... A44B 18/00 24/306
5,894,640 A 4/1999 Dewey
5,974,701 A * 11/1999 Busch ..... A43B 11/00 223/111
6,123,601 A * 9/2000 Hildebrandt ..... A41F 1/006 24/306
7,219,405 B1 * 5/2007 Nevens ..... A41F 11/04 24/306
7,437,837 B2 10/2008 Jacobs
8,898,936 B1 * 12/2014 Thompson-Boothe ..... A43B 11/00 36/138
9,386,875 B2 * 7/2016 Clifton ..... A47G 25/82
2006/0032032 A1 * 2/2006 Cheng ..... F16L 3/23 24/306
2006/0143875 A1 * 7/2006 Kunold ..... B65D 33/1616 24/30.5 R
2010/0036304 A1 * 2/2010 Norton ..... A43B 7/20 602/27
2010/0319219 A1 12/2010 Attilieni
2011/0226821 A1 * 9/2011 McGuire ..... A43B 1/0081 223/118
2015/0083761 A1 * 3/2015 Clifton ..... A47G 25/82 223/118

* cited by examiner

*Primary Examiner* — Khoa Huynh
*Assistant Examiner* — Jocelyn Wu
(74) *Attorney, Agent, or Firm* — Scherrer Patent & Trademark Law, P.C.; Stephen T. Scherrer; Monique A. Morneault

(57) ABSTRACT

Shoe fastening apparatuses are used with shoes having hook-and-loop tying straps. The shoe fastening apparatuses comprise a hook-and-loop strap having a loop of material or a ring on a terminal end thereof. Systems of the present invention further comprise an engagement apparatus for manipulating the hook-and-loop strap and, more specifically, the loop of material or the ring thereof. Methods of using the shoe fastening apparatuses and the systems thereof are further provided herein.

20 Claims, 6 Drawing Sheets

- PRIOR ART -

- PRIOR ART -

SHOE FASTENING APPARATUSES, SYSTEMS AND METHODS OF USING THE SAME

TECHNICAL FIELD

The present invention relates to shoe fastening apparatuses for use with shoes having hook-and-loop tying straps. The shoe fastening apparatuses comprise a hook-and-loop strap having a loop of material or a ring on a terminal end thereof. Systems of the present invention further comprise an engagement apparatus for manipulating the hook-and-loop strap and, more specifically, the loop of material or the ring thereof. Methods of using the shoe fastening apparatuses and the systems thereof are further provided herein.

BACKGROUND

It is often difficult for certain individuals to tie their shoes. Indeed, while shoes are typically necessary for protecting the feet and for traction, certain individuals may have difficulty reaching their feet. Specifically, individuals may include the very young, the elderly, and individuals at any age with disabilities that restrict their movements. Oftentimes, while an individual may be able to place their feet within a shoe, actually tying the shoelaces is almost if not impossible.

Shoes are presently made that are meant to be easier for individuals to tie or otherwise snugly engage attachment means so that shoes fit snugly on an individual's feet. One example of such a product includes shoes with hook-and-loop straps that are provided in place of shoelaces. The hook-and-loop straps thus allow an individual to place their feet within the shoes, and then by physically manipulating the straps, the individual, theoretically, can engage the hook-and-loop straps to engage the same and snugly hold the shoes on the individual's feet. As illustrated in FIGS. 1A and 1B, a prior art shoe 10 having a hook-and-loop straps 12, 14 thereon is shown. The hook-and-loop straps 12, 14 each comprise a first portion 16 having a loop material (or a hook material) on a surface thereof and a second portion 18 having a mating hook material if the first portion 16 is a loop material (or a mating loop material if the first portion 16 comprises a hook material). A ring 20 disposed at a midpoint to the hook-and-loop straps 12, 14 may allow the hook-and-loop straps 12, 14 to fold between the first portion 16 and the second portion 18 so that the second portion 18 may be folded over and on top of the first portion 16, allowing the mating hook and loop surfaces of the first and second portions, 16, 18 to mate, thereby holding the hook-and-loop straps 12, 14 together.

However, while shoes having hook-and-loop straps may be easier in the sense that an individual having dexterity control of his or her fingers is not required to manually tie shoelaces these types of shoes are not altogether helpful for individuals that do not have the flexibility or dexterity to reach their shoes and manually grasp the hook-and-loop straps with their hands. Thus, a need exists for apparatuses, systems and methods providing easier engagement of hook-and-loop straps on shoes. More specifically, a need exists for apparatuses, systems and methods allowing an individual to physically manipulate the hook-and-loop straps on shoes without having the dexterity to reach the hook-and-loop straps.

Oftentimes, the hook-and-loop straps on shoes do not have any engagement element that would aid an individual in grasping the same without his or her hands. A need, therefore, exists for apparatuses, systems and methods allowing an individual to engage hook-and-loop straps on shoes with an appliance or other engagement apparatus so that the hook-and-loop straps may be manipulated from a distance. More specifically, a need exists for apparatuses, system and methods whereby an individual can remotely manipulate the hook-and-loop straps on shoes.

SUMMARY OF THE INVENTION

The present invention relates to shoe fastening apparatuses for use with shoes having hook-and-loop tying straps. The shoe fastening apparatuses comprise a hook-and-loop strap having a loop of material or a ring on a terminal end thereof. Systems of the present invention further comprise an engagement apparatus for manipulating the hook-and-loop strap and, more specifically, the loop of material or the ring thereof. Methods of using the shoe fastening apparatuses and the systems thereof are further provided herein.

To this end, in an embodiment of the present invention, a hook-and-loop strap system for aiding in wearing a shoe by a person of limited mobility is provided. The hook-and-loop system comprises: a shoe fastening strap having a first surface and a second surface, the first surface comprising a hook material and a second surface comprising a loop material, wherein the hook material and the loop material are configured to mate and bind together when in contact, the shoe fastening strap having an extension element on a terminal end thereof; and a shoe having a hook-and-loop strap thereon for closing the shoe on a user's foot, the hook-and-loop strap having a first section of a loop material and a second section of a hook material, wherein the hook material of the second section is configured to mate and bind together with the loop material of the first section when the second section is folded over and on top of the first section, wherein the first surface of the shoe fastening strap comprising the hook material is disposed on and in contact with the first section of the loop material of the hook-and-loop strap of the shoe and the second section of the hook material of the hook-and-loop strap of the shoe is disposed on and in contact with the second surface of the loop material of the shoe fastening strap, such that the shoe fastening strap is sandwiched between the first section and the second section of the hook-and-loop strap and the loop extends beyond the hook-and-loop strap.

In an embodiment, the extension element is a ring.

In an embodiment, the ring is a D-ring.

In an embodiment, the extension element comprises a loop comprising a terminal end of material of the strap folded over on top of itself and held together by holding means selected from the group consisting of adhesive, stitching and combinations thereof.

In an embodiment, the hook-and-loop strap system further comprises a ring extending from the loop.

In an embodiment, the shoe comprises a plurality of hook-and-loop straps and each of the plurality of hook-and-loop straps has a shoe fastening strap sandwiched therein.

In an alternate embodiment of the present invention, a shoe aid appliance is provided. The shoe aid appliance comprises: a pole having a first end and a second end, the first end comprising a handle for grasping by a user and the second end comprising a first rod portion extending from a side of the end at roughly perpendicular to the pole, and a first hook extending from the second end.

In an embodiment, the pole comprises a cap on the second end thereof, and the rod portion and the first hook extend from the cap.

In an embodiment, the cap is frictionally held to the pole.

In an embodiment, the shoe aid appliance further comprises: a second rod portion extending from an opposite side of the pole at roughly perpendicular to the pole.

In an embodiment, the first rod portion and the second rod portion are parts of the same rod.

In an embodiment, the rod extends through the second end of the pole.

In an embodiment, the shoe aid appliance further comprises: a second hook extending from the second end of the pole.

In an embodiment, the first hook and the second hook having hook elements facing opposite directions.

In yet another alternate embodiment of the present invention, a method of manipulating a shoe having at least one hook-and-loop strap, the method comprises the steps of: providing a shoe fastening strap having a first surface and a second surface, the first surface comprising a hook material and a second surface comprising a loop material, wherein the hook material and the loop material are configured to mate and bind together when in contact, the shoe fastening strap having an extension element on a terminal end thereof; and providing a shoe having a hook-and-loop strap thereon for closing the shoe on a user's foot, the hook-and-loop strap having a first section of a loop material and a second section of a hook material, wherein the hook material of the second section is configured to mate and bind together with the loop material of the first section when the second section is folded over and on top of the first section; opening the hook-and-loop strap of the shoe; placing the shoe fastening strap on the hook-and-loop strap of the shoe such that the first surface of the shoe fastening strap comprising the hook material is disposed on and in contact with the first section of the loop material of the hook-and-loop strap of the shoe; closing the second section of the hook material of the hook-and-loop strap so that the second section of the hook material is disposed on and in contact with the second surface of the loop material of the shoe fastening strap, such that the shoe fastening strap is sandwiched between the first section and the second section of the hook-and-loop strap and the extension element extends beyond the hook-and-loop strap.

In an embodiment, the method further comprises the step of: grasping the extension element extending beyond the hook-and-loop strap of the shoe and pulling upwardly, thereby separating the first surface of the hook material of the shoe fastening strap from the first section of the loop material of the hook-and-loop strap of the shoe.

In an embodiment, the extension element is selected from the group consisting of a loop, a ring and combinations thereof.

In an embodiment, the method further comprises the steps of: providing a shoe aid appliance comprising a pole having a first end and a second end, the first end comprising a handle for grasping by a user and the second end comprising a first rod portion extending from a side of the second end at roughly perpendicular to the pole, and a first hook extending from the second end; and retrieving the shoe using the first rod portion extending from a side of the second end of the pole.

In an embodiment, the method further comprises the steps of: providing a shoe aid appliance comprising a pole having a first end and a second end, the first end comprising a handle for grasping by a user and the second end comprising a first rod portion extending from a side of the second end at roughly perpendicular to the pole, and a first hook extending from the second end; and hooking the extension element via the hook of the shoe aid appliance.

In an embodiment, the method further comprises the step of: pulling upwardly on the shoe aid appliance when the extension element is hooked by the hook to open the hook-and-loop strap of the shoe.

It is, therefore, an advantage and objective of the present invention to provide apparatuses, systems and methods providing easier engagement of hook-and-loop straps on shoes.

More specifically, it is an advantage and objective of the present invention to provide apparatuses, systems and methods allowing an individual to physically manipulate the hook-and-loop straps on shoes without having the dexterity to reach the hook-and-loop straps.

Moreover, it is an advantage and objective of the present invention to provide apparatuses, systems and methods allowing an individual to engage hook-and-loop straps on shoes with an appliance or other engagement apparatus so that the hook-and-loop straps may be manipulated from a distance.

More specifically, it is an advantage and objective of the present invention to provide apparatuses, system and methods whereby an individual can remotely manipulate the hook-and-loop straps on shoes.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to shoe fastening apparatuses for use with shoes having hook-and-loop tying straps. The shoe fastening apparatuses comprise a hook-and-loop strap having a loop of material or a ring on a terminal end thereof. Systems of the present invention further comprise an engagement apparatus for manipulating the hook-and-loop strap and, more specifically, the loop of material or the ring thereof. Methods of using the shoe fastening apparatuses and the systems thereof are further provided herein.

Figure 1A:
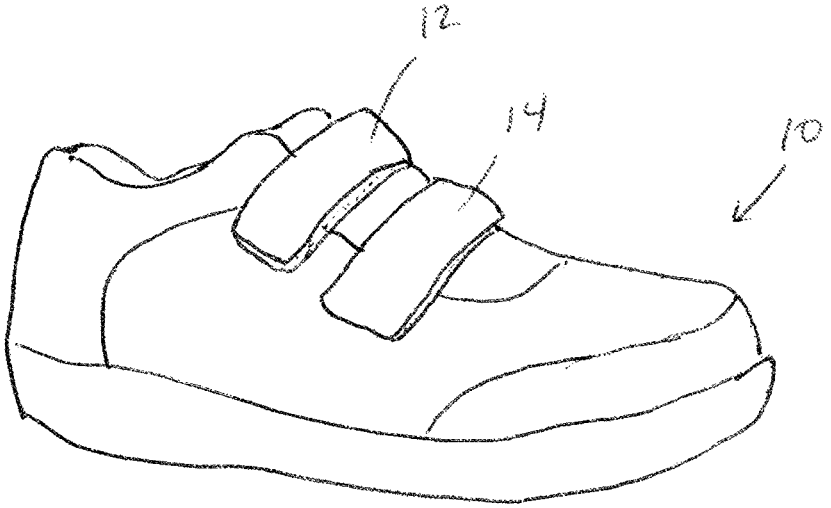
FIGS. 1A-1B illustrate a prior art shoe having hook-and-loop fastening straps in a closed and open configuration, respectively.
Figure 1B:
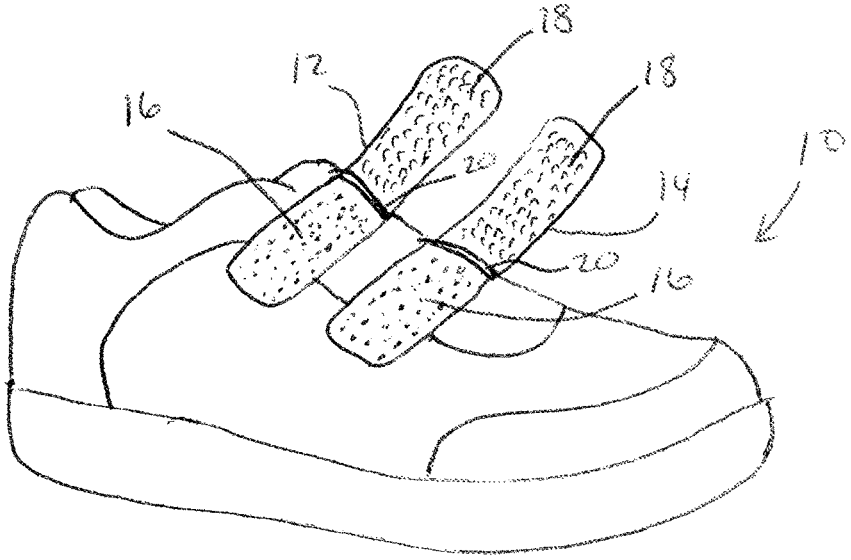
Figure 2A:
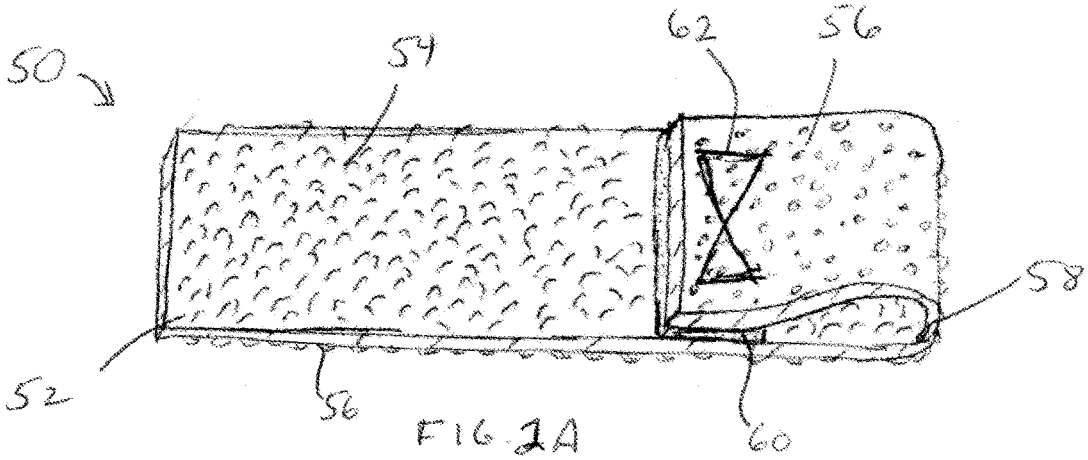
FIGS. 2A-2B illustrate top and bottom perspective view of a shoe fastening apparatus in an embodiment of the present invention.
Figure 2B:
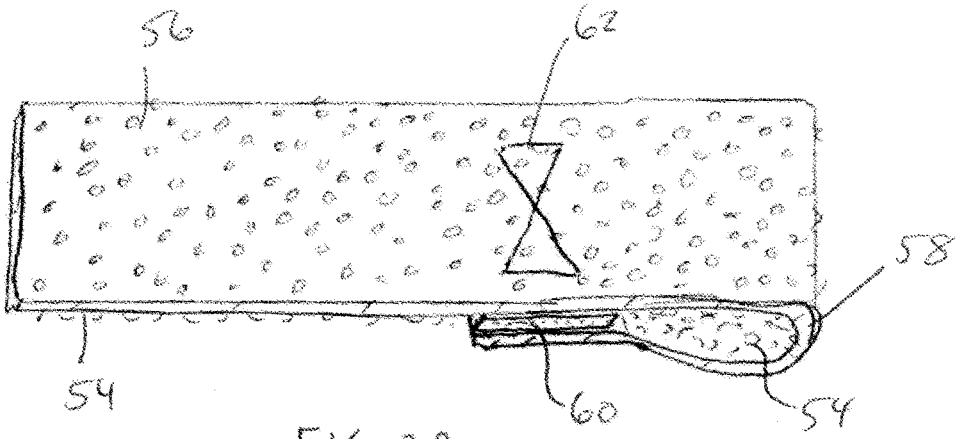

Now referring to the figures, wherein like numerals refer to like parts, FIGS. 2A and 2B illustrate a shoe fastening apparatus 50 in an embodiment of the present invention. The shoe fastening apparatus 50 comprises a strap 52 of comprising a hook material 54 disposed on a first surface of the strap 52 and a loop material 56 disposed on a second opposite surface of the strap 52. One end of the strap 52 may be bent or curled over and disposed onto itself forming a loop 58. To hold the loop 58 in place, an adhesive 60 may be utilized and/or the end of the strap 52 may be stitched via stitching 62, thereby holding the end of the strap 52 onto a middle portion of the strap 52. The loop 58 may be utilized by a user to grasp the strap 52 with an appliance or other apparatus, as described in more detail below, or with the user's hands to enable the user to better grasp the same when disposed on a shoe, as further described in more detail below.

Figure 3:
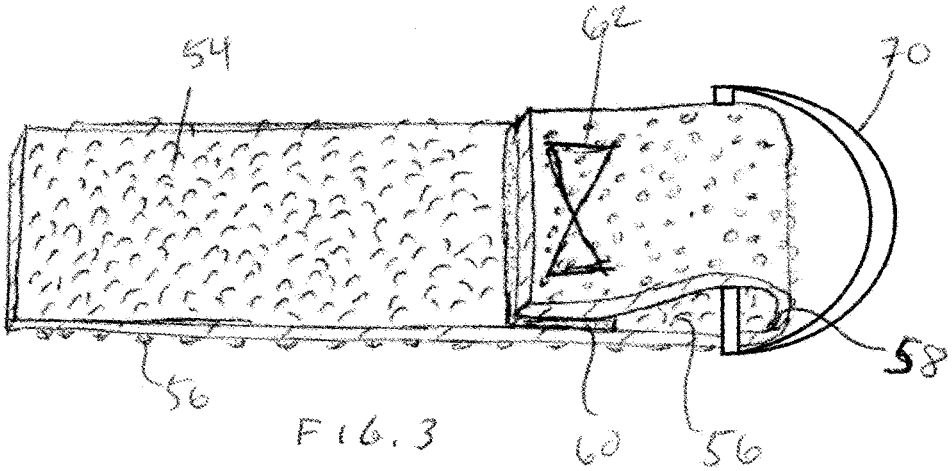
FIG. 3 illustrates a perspective view of a shoe fastening apparatus in an alternate embodiment of the present invention.

Alternatively, as illustrated in FIG. 3, a D-ring 70, or other like ring, hook or other extension element, may extend from the loop 58, thereby providing means to grasp the strap 52 by a user's hand or an appliance or apparatus, as described in more detail below. The D-ring 70 may be disposed through the loop 58, or may be connected or attached to the strap 52 in any other manner as apparent to one of ordinary skill in the art.

Figure 4:
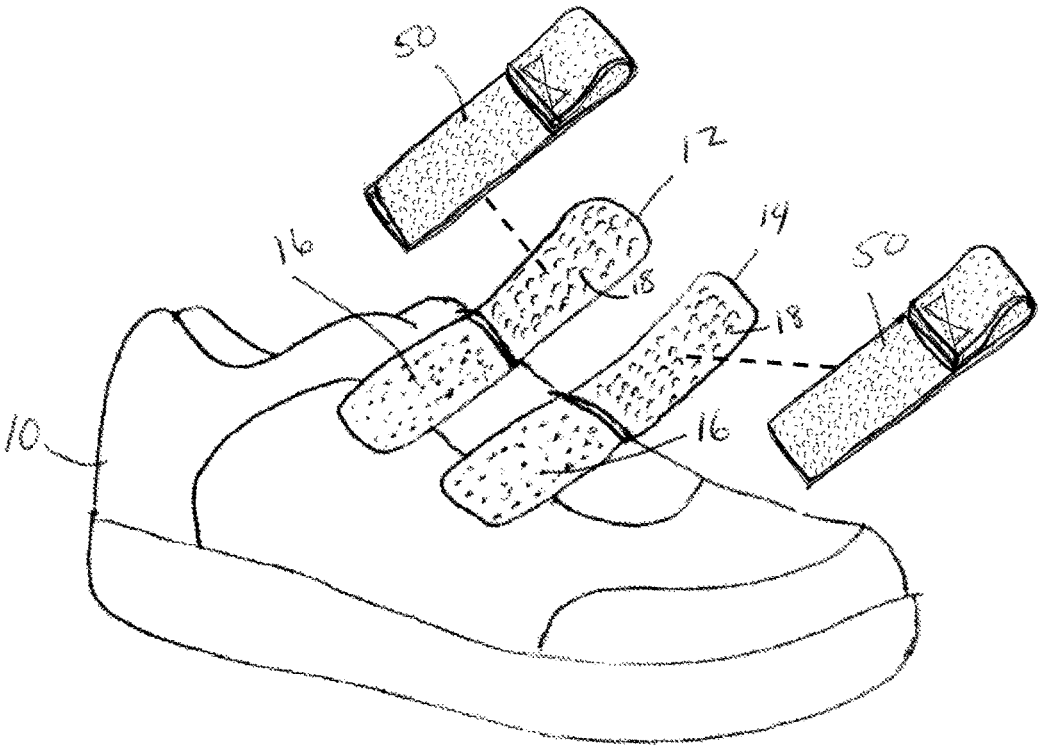
FIG. 4 illustrates a shoe having hook-and-loop fastening straps in an open configuration with a pair of shoe fastening apparatuses in an embodiment of the present invention.
Figure 5:
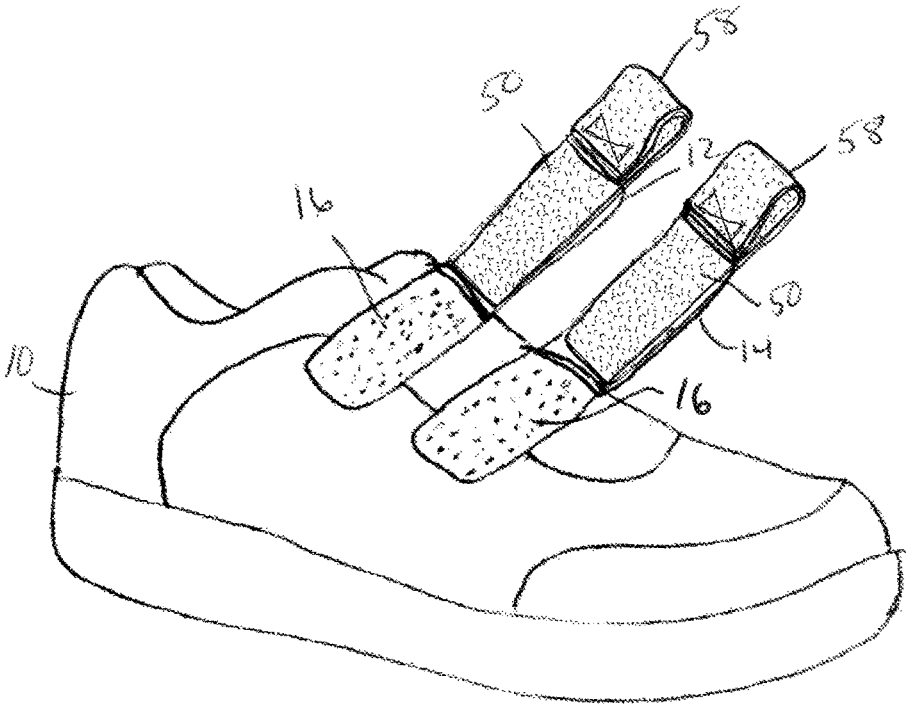
FIG. 5 illustrates a shoe having hook-and-loop fastening straps in an open configuration with a pair of shoe fastening apparatuses mated thereon in an embodiment of the present invention.
Figure 6:
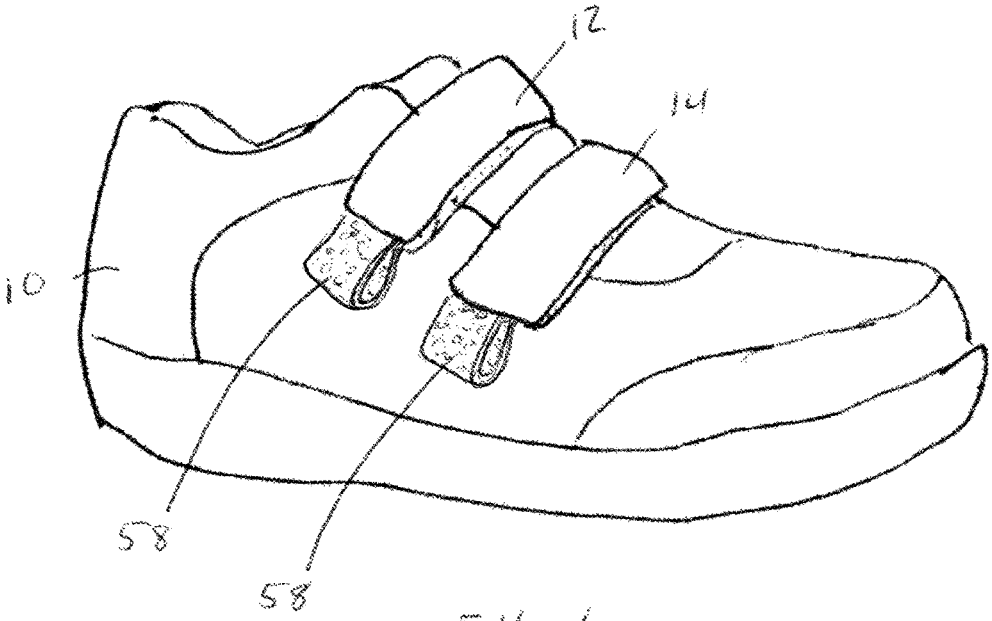
FIG. 6 illustrates a shoe having hook-and-loop fastening straps with a pair of shoe fastening apparatuses mated thereon, with the hook-and-loop fastening straps disposed in a closed configuration in an embodiment of the present invention.

FIG. 4 illustrates a shoe 10 having hook-and-loop straps 12, 14, wherein the hook-and-loop straps 12, 14 are open to expose the loop surface 16 and the hook surface 18. In a preferred embodiment, the loop surface 56 of the shoe fastening apparatus 50 may be mated with the hook surface 18 of both the hook-and-loop straps 12, 14, wherein the loop 58 extends beyond the hook surface 18, as illustrated in FIG. 5. Thus, the hook surface 18 having the shoe fastening apparatus 50 mated thereon may be folded and closed, allowing the hook surface 56 of the shoe fastening apparatus 50 to mate with the loop surface 16 of the hook-and-loop fasteners 12, 14 of the shoe 10, as illustrated in FIG. 6. Thus, the loops 58 may be exposed and accessible to a user, either for manually grasping the same or grasping via an appliance or other apparatus, as described in more detail below.

Figure 7:
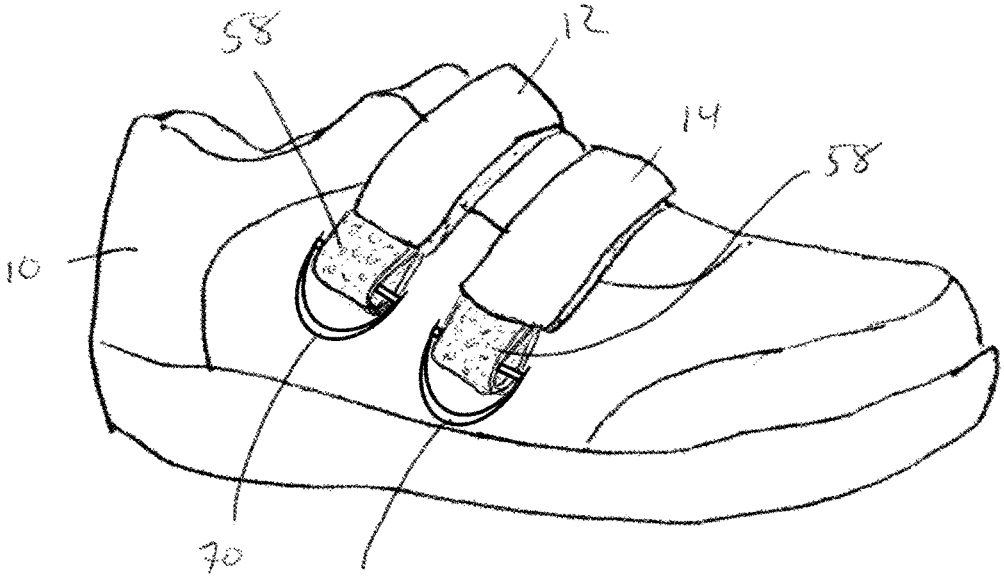
FIG. 7 illustrates a shoe having hook-and-loop fastening straps with a pair of shoe fastening apparatuses mated thereon, with the hook-and-loop fastening straps disposed in a closed configuration in an alternate embodiment of the present invention.

FIG. 7 illustrates shoe 10 having the shoe fastening apparatus 50 with a D-ring 70 attached thereto and further exposed and accessible, allowing for easier access and grasping, either manually or via an appliance or other apparatus, as described in more detail below.

Figure 8:
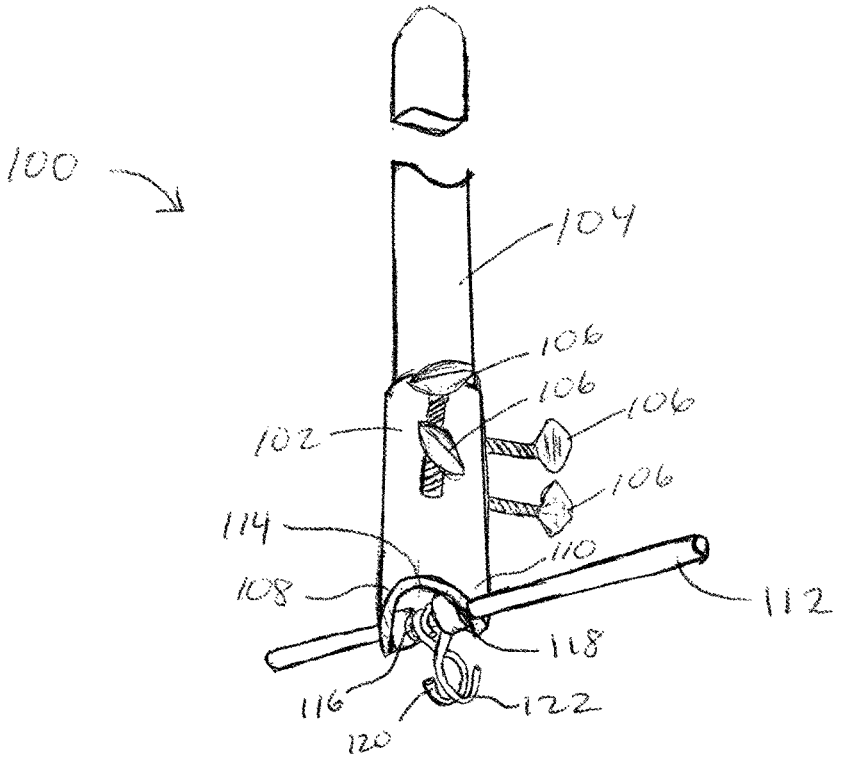
FIG. 8 illustrates a shoe aid appliance for individuals with limited mobility in an embodiment of the present invention.

FIG. 8 illustrates a shoe aid appliance 100 in an embodiment of the present invention. The shoe aid appliance 100 may comprise a housing or cap 102 that may be disposed on a pole, rod or other extension 104 (referred to herein as a "pole"). The pole 104 may be a wooden pole, a plastic pole, a metal pole, or made from any other material, and may be utilized by a user to extend the shoe aid appliance 100 from his or her hands to aid the use in retrieving and/or manipulating a shoe, as described in more detail below. Further, the pole 104 may be extendible so that the pole extends from a relatively short configuration to a relatively long configuration, allowing the user larger reach when using the same for retrieving and/or manipulating a shoe.

The housing or cap 102 may be attached or otherwise connected to the pole 104 via friction bolts 106 that may be tapped through the housing or cap 102 and frictionally hold the pole 104 within the housing or cap 102. Alternatively, the housing or cap 102 may be integrally connected to or otherwise extend from the pole 104, and the present invention should not be limited as described herein.

The housing or cap 102 may have a first wing 108 and a second wing 110 extending from the housing or cap 102 through which a rod 112 may be disposed. The first and second wings 108, 110 may extend on either side of a curved terminal end 114 of the housing or cap 102, thereby providing easy access to the rod 112 disposed therein and ancillary components attached to the rod 112, as described below.

Disposed on the rod 112, within the area formed by the first and second wings 108 and the curved terminal end 114 of the housing or cap 102 may be spacers 116, 118 that hold in place a pair of oppositely-facing hooks 120, 122. The hooks 120, 122 may freely rotate on the rod 112 and may be utilized by a user thereof to hook onto elements of a shoe, as described in more detail below.

Figure 9:
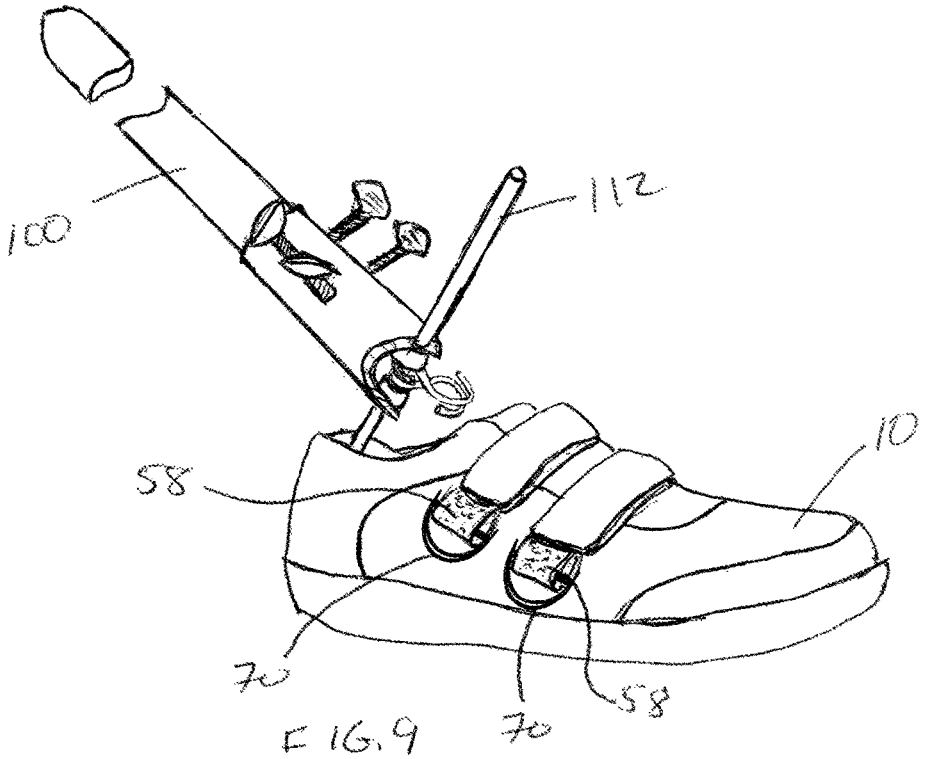
FIG. 9 illustrates a shoe aid appliance used to retrieve a shoe by an individual with limited mobility in an embodiment of the present invention.

As illustrated in FIG. 9, the shoe aid appliance 100 may be utilized to retrieve a shoe 10 that may be difficult for a user to reach because of the user's mobility problems. Thus, the rod 112 of the shoe aid appliance 100 may be disposed within the shoe 10 and dragged to the user, such as if the user is sitting on a chair or a bed, the shoe aid appliance 100 may "grab" the shoe 10 via the rod 112 and allow the user to drag the shoe 10 to the user so that he can utilize it and place the shoe 10 on his or her foot.

Figure 10:
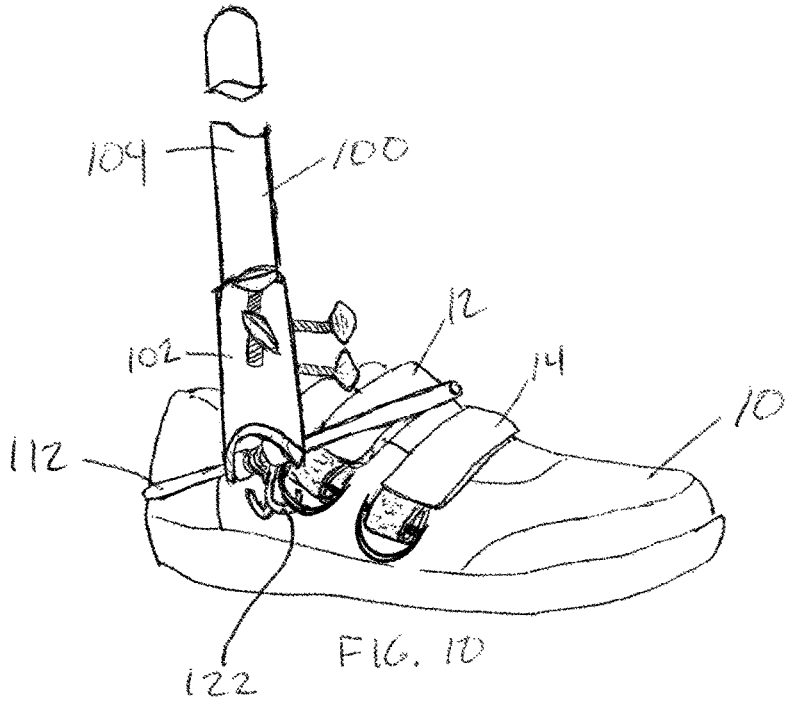
FIG. 10 illustrates a shoe aid appliance used to open a hook-and-loop strap on a shoe in an embodiment of the present invention.
Figure 11:
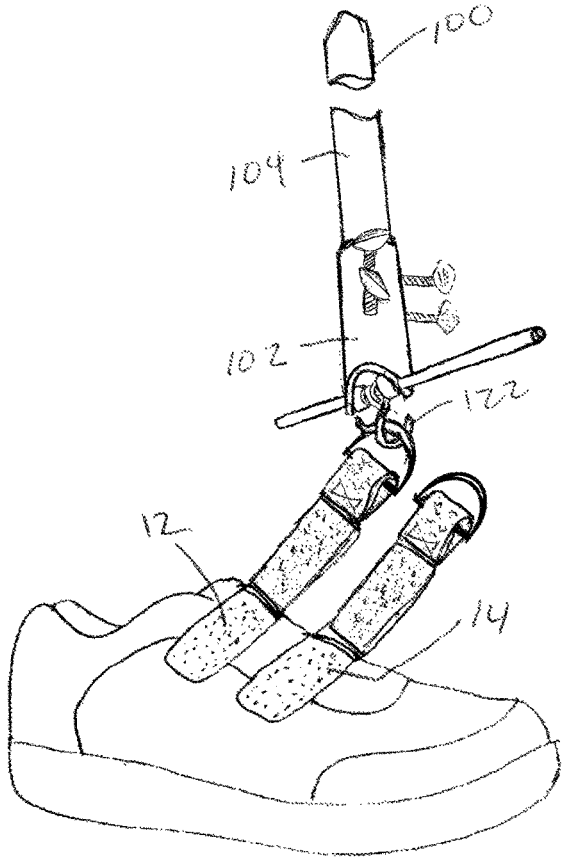
FIG. 11 illustrates a shoe aid appliance having opened hook-and-loop straps on a shoe in an embodiment of the present invention.

FIG. 10 illustrates the shoe aid appliance 100 utilized to grab D-ring 70 that may extend from loop 58 of shoe fastening apparatus 50 that may be sandwiched between the respective hook-and-loop portions of the hook-and-loop strap 12 or 14. The hook 122 (or hook 124, depending on which hook is easier to use based on the direction the hook portion is facing) may easily hook onto the D-ring 70, as shown in FIG. 10 by a user holding the handle 104 of the shoe aid appliance 100. FIG. 11 illustrates how a user may pull the shoe aid appliance 100 while the hook 122 is hooked onto D-ring 70, and open one or both of the hook-and-loop straps 12, 14. Thus, a user may easily open hook-and-loop straps 12, 14 and place his or her foot into shoe 10 via the shoe aid appliance 100. Likewise, the user may easily close hook-and-loop straps 12, 14 when his or her foot is placed inside. The shoe aid appliance 100 may allow the user to do so without physically touching the shoe 10.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A hook-and-loop strap system for aiding in wearing a shoe by a person of limited mobility comprising:

a shoe fastening strap having a first surface and a second surface, the first surface comprising a hook material and the second surface comprising a loop material, wherein the hook material and the loop material are configured to mate and bind together when in contact, the shoe fastening strap having an extension element on a terminal end thereof;

a shoe having a hook-and-loop strap thereon for closing the shoe on a user's foot, the hook-and-loop strap having a first section of a loop material and a second section of a hook material, wherein the hook material of the second section is configured to mate and bind together with the loop material of the first section when the second section is folded over and on top of the first section, wherein the first surface of the shoe fastening strap comprising the hook material is removably disposed on and in contact with the first section of the loop material of the hook-and-loop strap of the shoe and the second section of the hook material of the hook-and-loop strap of the shoe is removably disposed on and in contact with the second surface of the loop material of the shoe fastening strap, such that the shoe fastening strap is sandwiched between the first section and the second section of the hook-and-loop strap and the extension element extends beyond the hook-and-loop strap; and a shoe aid appliance comprising a pole having a first end and a second end, the first end comprising a handle for grasping by a user and the second end comprising a first rod portion extending from a side of the second end roughly perpendicular to the pole.

2. The hook-and-loop strap system of claim 1 wherein the extension element is a ring.

3. The hook-and-loop strap system of claim 2 wherein the ring is a D-ring.

4. The hook-and-loop strap system of claim 1 wherein the extension element comprises a loop comprising the terminal end of material of the strap folded over on top of itself and held together by holding means selected from the group consisting of adhesive, stitching and combinations thereof.

5. The hook-and-loop strap system of claim 4 comprising a ring extending from the loop.

6. The hook-and-loop strap system of claim 1 wherein the shoe comprises a plurality of hook-and-loop straps and each of the plurality of hook-and-loop straps has a shoe fastening strap sandwiched therein.

7. The hook-and-loop strap system of claim 1 wherein the pole further comprises:

a first hook extending from the second end.

8. The hook-and-loop strap system of claim 7 wherein the pole comprises a cap on the second end thereof, and the rod portion and the first hook extend from the cap.

9. The hook-and-loop strap system of claim 8 wherein the cap is frictionally held to the pole.

10. The hook-and-loop strap system of claim 1 further comprising:

a second rod portion extending from an opposite side of the pole roughly perpendicular to the pole.

11. The hook-and-loop strap system of claim 10 wherein the first rod portion and the second rod portion are parts of the same rod.

12. The hook-and-loop strap system of claim 11 wherein the rod extends through the second end of the pole.

13. The hook-and-loop strap system of claim 7 further comprising:

a second hook extending from the second end of the pole.

14. The hook-and-loop strap system of claim 11 wherein the first hook and the second hook having hook elements facing opposite directions.

15. A method of closing a shoe having at least one hook-and-loop strap, the method comprising the steps of:

providing a shoe fastening strap having a first surface and a second surface, the first surface comprising a hook material and the second surface comprising a loop material, wherein the hook material and the loop material are configured to mate and bind together when in contact, the shoe fastening strap having an extension element on a terminal end thereof;

providing a shoe having a hook-and-loop strap thereon for closing the shoe on a user's foot, the hook-and-loop strap having a first section of a loop material and a second section of a hook material, wherein the hook material of the second section is configured to mate and bind together with the loop material of the first section when the second section is folded over and on top of the first section;

providing a shoe aid appliance comprising a pole having a first end and a second end, the first end comprising a handle for grasping by a user and the second end comprising a first rod portion extending from a side of the second end roughly perpendicular to the pole;

opening the hook-and-loop strap of the shoe with the shoe aid appliance;

placing the shoe fastening strap on the hook-and-loop strap of the shoe such that the first surface of the shoe fastening strap comprising the hook material is removably disposed on and in contact with the first section of the loop material of the hook-and-loop strap of the shoe; and closing the second section of the hook material of the hook-and-loop strap with the shoe aid appliance so that the second section of the hook material is removably disposed on and in contact with the second surface of the loop material of the shoe fastening strap, such that the shoe fastening strap is sandwiched between the first section and the second section of the hook-and-loop strap and the extension element extends beyond the hook-and-loop strap.

16. The method of claim 15 further comprising the step of:

grasping the extension element extending beyond the hook-and-loop strap of the shoe and pulling upwardly, thereby separating the first surface of the hook material of the shoe fastening strap from the first section of the loop material of the hook-and-loop strap of the shoe.

17. The method of claim 15 wherein the extension element is selected from the group consisting of a loop, a ring and combinations thereof.

18. The method of claim 15 further comprising the step of:

retrieving the shoe using the first rod portion extending from the side of the second end of the pole.

19. The method of claim 15 further comprising the steps of:

providing the shoe aid appliance with a hook extending from the second end; and hooking the extension element via the hook of the shoe aid appliance.

20. The method of claim 19 further comprising the step of:

pulling upwardly on the shoe aid appliance when the extension element is hooked by the hook to open the hook-and-loop strap of the shoe.

* * * * *